US005464524A

United States Patent [19]

Ogiwara et al.

[11] Patent Number: 5,464,524

[45] Date of Patent: Nov. 7, 1995

[54] PLATING METHOD FOR A NICKEL-TITANIUM ALLOY MEMBER

[75] Inventors: Yoshiaki Ogiwara; Masaki Yasuhara; Akira Matsuda, all of Tokyo, Japan

[73] Assignee: The Furukawa Electric Co., Ltd., Tokyo, Japan

[21] Appl. No.: 297,600

[22] Filed: Aug. 29, 1994

[30] Foreign Application Priority Data

Sep. 17, 1993 [JP] Japan ..... 5-231581

[51] Int. Cl.[6] ..... C25D 5/14; C25D 5/38; C25D 5/40

[52] U.S. Cl. ..... 205/170; 205/181; 205/182; 205/212; 205/216; 205/219

[58] Field of Search ..... 205/181, 170, 205/182, 212, 216, 219

[56] References Cited

U.S. PATENT DOCUMENTS 4,525,250 6/1985 Fahrmbacher-Lutz et al. ..... 205/212

FOREIGN PATENT DOCUMENTS 61-87894 5/1986 Japan .
63-14893 1/1988 Japan .
63-186891 8/1988 Japan .
63-274793 11/1988 Japan .
2-73991 3/1990 Japan .

*Primary Examiner*—John Niebling
*Assistant Examiner*—Edna Wong
*Attorney, Agent, or Firm*—Frishauf, Holtz, Goodman, Langer & Chick

[57] ABSTRACT

A plating method for a nickel-titanium alloy member is provided which comprises the steps of: subjecting a nickel-titanium alloy member to an anodic electrolyzing treatment and a cathodic electrolyzing treatment in succession by using an electrolyte containing hydrochloric acid as an essential component thereof, in particular, an electrolyte having a chloride ion concentration of 0.1 mol/l or more and a pH value of 2 or less, or an electrolyte having a chloride ion concentration of 0.4 mol/l or more, or still preferably, an electrolyte having a chlorine ion concentration of 0.3 mol/l or more and a pH value of 2 or less; strike plating the treated nickel-titanium alloy member with a desired metal; and electroplating the struck nickel-titanium alloy member with a desired metal. The adhesion between the nickel-titanium alloy member and a plating layer is very good.

13 Claims, No Drawings

PLATING METHOD FOR A NICKEL-TITANIUM ALLOY MEMBER

BACKGROUND OF THE INVENTION

FIELD OF THE INVENTION

The present invention relates to a plating method for a nickel-titanium alloy member, and more specifically, to a method for forming a plating layer on the surface of the nickel-titanium alloy member with high adhesion. oxide film exists on the surface of each nickel-titanium alloy member from the beginning, however, the members cannot be easily brazed or soldered in this state.

In many cases, therefore, screwing, riveting, caulking, and other mechanical methods are used to connect the nickel-titanium alloy members to one another.

If any of these method is employed, however, the appearance of spectacle frames may possibly be marred, for example. In the case of an electrical component, moreover, electrical connection failure is liable to occur at the junctions.

Furthermore, the nickel-titanium alloy members may be also connected by soldering or brazing after they are plated with nickel or copper.

In this case, the nickel-titanium alloy members are dipped in hydrochloric acid, a liquid mixture of fluoric acid and nitric acid, a liquid mixture of hydrochloric acid and nitric acid, or a liquid mixture of hydrochloric acid, sulfuric acid and nitric acid, for pickling, whereby the oxide film on the surface of each member is removed by dissolution as a pretreatment, and the member surface is then plated with nickel or copper. The pretreatment serves to improve the adhesion between the surface of each nickel-titanium alloy member and the plating layer formed thereon.

Despite the pretreatment, however, the adhesion between the plating layer and the surface of each nickel-titanium alloy member cannot always be satisfactory, and the formed plating layer may often be cracked or separated from the member surface. When the plated nickel-titanium alloy members are bonded together by soldering or brazing, moreover, the bonding strength is low, and the electrical connection is unstable.

Supposedly, these problems are attributable to the following reason.

Conventionally, the solution used for the pickling contains nitric acid, because the nitric acid contained serves to enhance the capacity of removing the oxide film existing from the outset. Since nitric acid has an oxidative effect, however, a new oxide film is formed on the surface of the nickel-titanium alloy member. Although the newly formed oxide film is thinner than the oxide film having been existing on the surface of the member from the beginning, it adversely affects the adhesion of the plating layer formed, all the same. Where hydrofluoric acid is contained in the solution, it is not essential to mix nitric acid as mentioned above. In this case, however, difficulties arise in the disposal of waste liquid containing hydrofluoric acid.

OBJECT AND SUMMARY OF THE INVENTION

The object of the present invention is to provide a method for forming a plating layer on the surface of a nickel-titanium alloy member with high adhesion, and more specifically, to provide a method for pretreatment of the surface of the nickel-titanium alloy member before the formation of the plating layer.

To achieve the above object, the present invention provides a plating method for a nickel-titanium alloy member, which comprises the steps of: subjecting a nickel-titanium alloy member to an anodic electrolyzing treatment and a cathodic electrolyzing treatment in succession by using an electrolyte containing hydrochloric acid as an essential component thereof; strike plating the treated nickel-titanium alloy member with a desired metal; and electroplating the struck nickel-titanium alloy. member with a desired metal.

Preferably, the anodic electrolyzing treatment and the cathodic electrolyzing treatment are carried out using an electrolyte having a chloride ion concentration of 0.1 mol/l or more and a pH value of 2 or less, or an electrolyte having a chloride ion concentration of 0.4 mol/l or more.

DETAILED DESCRIPTION OF THE INVENTIONS

According to the present invention, a nickel-titanium alloy member is subjected to an electrolyzing treatments and a cathodic electrolyzing treatment in the order named.

In these electrolyzing treatments, the nickel-titanium alloy member and an insoluble electrode, such as a Pt or Pt plated Ti, are dipped in an electrolyte, which will be mentioned later, and an electric current with a predetermined density is applied with use of the alloy member as an anode for the case of the anodic electrolyzing treatment and as a cathode for the case of the cathodic electrolyzing treatment.

In this case, the oxide film, having been on the surface of the nickel-titanium alloy member from the beginning, is dissolved and removed in the anodic electrolyzing treatment which comes first. In the course of this process, however, the nickel-titanium alloy member (anode) continues to be anodized. While the initial oxide film is dissolved and removed, therefore, a new oxide film is formed on the surface of the member. Thus, at the end of the anodic electrolyzing treatment, the new oxide film exists in place of the initial one on the surface of the nickel-titanium alloy member.

However, the new oxide film is reduced by the cathodic electrolyzing treatment in the next stage, and is thoroughly removed from the surface of the nickel-titanium alloy member.

With the execution of the anodic electrolyzing treatment only, therefore, a thin oxide film appears on the surface of the nickel-titanium alloy member at the time of electroplating in the subsequent stage, so that the adhesion of the resulting plating layer is worsened. Although the oxide film having been on the surface of the nickel-titanium alloy member from the beginning can be removed by the cathodic electrolyzing treatment only, the effect of removal is too small to ensure economy.

According to the pretreatment of the present invention, therefore, the two electrolyzing treatments are executed including the anodic electrolyzing treatment as a first stage and the cathodic electrolyzing treatment as a second stage.

The electrolyte used in the electrolyzing treatments contains chloride ions as its essential component. Preferably, an electrolyte having a chlorine ion concentration of 0.1 mol/l or more and a pH value of 2 or less, or an electrolyte having a chlorine ion concentration of 0.4 mol/l or more is used. A still preferred electrolyte is an electrolyte having a chlorine ion concentration of 0.3 mol/l or more and a pH value of 2 or less.

If the anodic and cathodic electrolyzing treatments are executed with use an electrolyte which does not fulfill both these conditions, the effect of removal of the oxide film having been existing on the surface of the nickel-titanium alloy member from the beginning is small. Thus, it is difficult to remove the oxide film thoroughly, or the anodic electrolyzing treatment time necessary for the thoroughgoing removal is too long to be industrially practical.

Hydrochloric acid, sodium chloride, potassium chloride, etc. may be used as a chloride ion source of the electrolyte. Among these sources, hydrochloric acid is the best choice because it is easily available and adjustable in concentration, and ensures a great effect for the removal of the oxide film.

The electrolyte may contain other ions, such as sulfate ions, nitrate ions, etc., besides chlorine ions. If these ions are contained in excess, however, the removal effect of the oxide film on the surface of the nickel-titanium alloy member lowers in the course of the anodic electrolyzing treatment. In the case where the electrolyte contains excess of nitrate ions which have an oxidative effect, in particular, the oxide film cannot be satisfactorily removed during the electrolyzing treatments, so that the adhesion of the resulting plating layer on the surface of the treated nickel-titanium alloy member lowers considerably.

In the case where the electrolyte contains nitrate ions, therefore, it is advisable to adjust the ratio of the nitrate ion concentration ($[NO_3^-]$) to the chloride ion concentration ($[Cl^-]$), that is, $[NO_3^-]/[Cl^-]$, to 0.2 or less.

If sulfate ions are contained in the electrolyte, on the other hand, they exert no substantial influence upon the effect of removal of the oxide film during the electrolyzing treatments. Therefore, the electrolyte for the electrolyzing treatments may be also prepared by using sulfuric acid and sodium chloride as a pH adjuster and a chlorine ion source, respectively.

Hydrofluoric acid may be contained in the electrolyte. If the electrolyte containing hydrofluoric acid is used however, washing water contains fluorine after it is used to rinse the treated nickel-titanium alloy member thus requiring drainage which entails an economical loss. If the treatment time is too long, for example, the alloy member itself is inevitably dissolved. In the case of the electrolyte containing hydrofluoric acid therefore, the fluorine ion concentration should preferably be restricted to 0.1 mol/l or less.

Preferably the anodic electrolyzing treatment is executed with the current density of 1 to 20 $A/dm^2$. If the current density is lower than 1 $A/dm^2$, the time required for the removal of the oxide film having been existing on the surface of the nickel-titanium alloy member from the beginning, that is, treatment time, is extremely long. If the current density used is higher than 20 $A/dm^2$, on the other hand sparking or some other trouble may be caused during conduction.

With use of the current density within the aforesaid range, the treatment time of about 1 to 10 minutes is enough for the removal of the initial oxide film under normal conditions.

The cathodic electrolyzing treatment may be also executed with the current density of 1 to 20 $A/dm^2$. If the current density is lower than 1$A/dm^2$, the reducing capability of the newly formed oxide film is low, and the thoroughgoing removal of the oxide film requires a long time. If the current density used is higher than 20 $A/dm^2$, on the other hand sparking or some other trouble may be caused during conduction.

As in the case of the anodic electrolyzing treatment, the treatment time of about 1 to 10 minutes is enough for the removal of the newly formed oxide film.

After having undergone the two successive electrolyzing treatments in this manner, the nickel-titanium alloy member has a clean surface without any oxide film thereon. If the alloy member under this surface condition is electroplated directly with a target metal, however, the adhesion between itself and the plating layer thereon cannot be very high.

This is because the aforesaid surface condition is a condition that the surface is active and susceptible to oxidation. More specifically, when a plating layer of a predetermined thickness is to be formed on the surface of the nickel-titanium alloy member by dipping the alloy member in an electroplating bath, the active. surface is partially oxidized by the plating bath so that a thin oxide film is formed thereon before the plating layer built up.

According to the present invention, therefore, the nickel-titanium alloy member having undergone the electrolyzing treatments is struck after it is rinsed, whereupon a strike plating layer of a desired metal is formed on the surface of the alloy member. Since this strike plating layer can be formed in a very short period of time, the active surface of the alloy member is coated with the highly adherent strike plating layer before it is oxidized by the plating bath.

Thereafter, the strike plating layer is electroplated with the target metal. In the course of this electroplating process, the. surface of the nickel-titanium alloy member, having already been coated with the strike plating layer, is not oxidized by the electroplating bath. Thus, the resulting plating layer adheres firmly to the strike plating layer.

The strike plating layer and the plating layer formed thereon by the electroplating may be made of the same metal or different metals. The strike plating is not limited to a one-stroke operation, and may be repeated twice or more.

In view of the conformability to the surface of the nickel-titanium alloy member, the resulting plating layer can adhere firmly to the alloy member if the surface of the alloy member is struck with nickel, and finally electroplated with copper.

EXAMPLE 1

Wires each composed of 50% nickel and 50% titanium by weight and having the diameter of 1.0 mm and length of 200 mm were plated with nickel in the following manner.

Water solutions of hydrochloric acid with various chloride ion concentrations shown in Table 1 were prepared by adding hydrochloric acid to ion-exchange water. Pickling agents were obtained by adjusting these water solutions to various pH values shown in Table 1 by means of sulfuric acid and sodium hydroxide.

The wires were dipped individually in these pickling agents, and were subjected to the anodic and cathodic electrolyzing treatments in the order named.

In both these processes, the current density and the treatment time were adjusted to 5 $A/dm^2$ and one minute, respectively.

Subsequently, The surfaces of the treated wires were struck with nickel under conditions including a plating bath of 240 g/l nickel chloride and 125 ml/l hydrochloric acid, bath temperature of 60° C., current density of 8 $A/dm^2$, and plating time of 30 seconds, respectively.

Subsequently, wires were rinsed after the strike plating, and surfaces of the struck wires were plated with nickel under conditions including a plating bath of 250 g/l nickel sulfamate, 10 g/l nickel chloride, and 40 g/l boric acid, bath temperature of 40° C., current density of 8 $A/dm^2$, and plating time of 3 minutes, respectively.

The resulting plated wires were fully rinsed in water, dried, and then subjected to the following adhesion test.

Each wire kept in a nonrestricted state was repeatedly bent at 180° with its opposite ends held in position, and the number of times the wire was bent before the plating layer peeled from the wire was measured.

The larger this number of times, the better the adhesion between the plating layer and the wire surface would be.

Table 1 shows the result of this test in terms of the relationships between [$Cl^-$] and pH.

TABLE 1

| | | pH value | | | |
|---|---|---|---|---|---|
| | | −2.0 | 0.0 | 2.0 | 4.0 |
| [$Cl^-$] (mol/l) | 0.1 | 140 | 132 | 134 | 94 |
| | 0.2 | 191 | 156 | 157 | 102 |
| | 0.3 | 312 | 308 | 297 | 117 |
| | 0.4 | 315 | 325 | 306 | 131 |
| | 1.0 | 376 | 357 | 322 | 126 |
| | 5.0 | 384 | 369 | 349 | 177 |
| | 10.0 | 365 | 328 | 313 | 208 |

As seen from Table 1, the adhesion between the nickel plating layer and the wire surface is much improved when the chloride ion concentration ([$Cl^-$]) and the pH value of the pickling agent are 0.3 mol/l or more and 2 or less, respectively.

EXAMPLE 2

The nickel-titanium alloy members of Example 1 were subjected to 45 seconds of the anodic electrolyzing treatment and another 45 seconds of the cathodic electrolyzing treatment with the current density of 10 A/dm$^2$, by the use of pickling agents obtained by adjusting the chloride ion concentration by means of sodium chloride added to ion-exchange water and adjusting the pH value by means of sulfuric acid only.

Subsequently, after the wires were fully rinsed in water, their surfaces were struck with copper under conditions including a plating bath of 30 g/l cuprous cyanide and 15 g/l free sodium cyanide, bath temperature of 45° C., current density of 5 A/dm$^2$, and plating time of 30 seconds.

After the struck wires were fully rinsed in water, their surfaces were plated with copper under conditions including a plating bath of 200 g/l copper sulfate, 60 g/l sulfuric acid, 1 g/l sodium chloride, and 5 g/l glue, bath temperature of 30° C., current density of 4 A/dm$^2$, and plating time of 6 minutes.

The resulting plated wires were subjected to the same adhesion test of Example 1. Table 2 shows the result of this test in terms of the relationships between [$Cl^-$] and pH.

TABLE 2

| | | pH value | | | |
|---|---|---|---|---|---|
| | | −2.0 | 0.0 | 2.0 | 4.0 |
| [$Cl^-$] (mol/l) | 0.1 | 118 | 130 | 75 | 61 |
| | 0.2 | 140 | 194 | 115 | 67 |
| | 0.3 | 296 | 298 | 295 | 98 |
| | 0.4 | 303 | 318 | 292 | 102 |
| | 1.0 | 321 | 348 | 323 | 98 |
| | 5.0 | 343 | 357 | 353 | 108 |
| | 10.0 | 319 | 378 | 338 | 159 |

As seen from Table 2, the adhesion between the copper plating layer and the wire surface is much improved when the chloride ion concentration ([$Cl^-$]) and the pH value of the pickling agent are 0.3 mol/l or more and 2 or less, respectively.

EXAMPLE 3

The wires used in Example 1 were plated with gold in the following manner.

Water solutions of hydrochloric acid with various chloride ion concentrations shown in Table 3 were prepared by adding hydrochloric acid to ion-exchange water. Pickling agents were obtained by adjusting these water solutions to various pH values shown in Table 3 by means of sulfuric acid and sodium hydroxide.

The wires were dipped individually in these pickling agents, and were subjected to the anodic and cathodic electrolyzing treatments in the order named.

In both these processes, the current density and the treatment time were adjusted to 10 A/dm$^2$ and 30 seconds, respectively.

Subsequently, after the treated wires were fully rinsed in water, their surfaces were struck with nickel under the same conditions of Example 1.

After the struck wires were fully rinsed in water, their surfaces were plated with gold under conditions including a plating bath of 15 g/l potassium gold cyanide, 100 g/l citric acid and potassium citrate, bath temperature of 45° C., current density of 1A/dm$^2$, and plating time of 5 minutes.

The resulting plated wires were subjected to the same adhesion test of Example 1. Table 3 shows the result of this test.

TABLE 3

| | | pH value | | | |
|---|---|---|---|---|---|
| | | −2.0 | 0.0 | 2.0 | 4.0 |
| [$Cl^-$] (mol/l) | 0.1 | 140 | 151 | 90 | 73 |
| | 0.2 | 166 | 213 | 136 | 70 |
| | 0.3 | 342 | 331 | 315 | 97 |
| | 0.4 | 368 | 376 | 354 | 118 |
| | 1.0 | 387 | 402 | 387 | 114 |
| | 5.0 | 398 | 418 | 422 | 129 |
| | 10.0 | 382 | 423 | 403 | 189 |

As seen from Table 3, the adhesion between the gold plating layer and the wire surface is much improved when the chloride ion concentration ([$Cl^-$]) and the pH value of the pickling agent are 0.3 mol/l or more and 2 or less, respectively.

EXAMPLE 4

Subsequently, influences of nitrate ions, if any, in pickling agents were examined.

Water solutions of hydrochloric acid with various chloride ion concentrations were prepared by adding hydrochloric acid to ion-exchange water. Four groups of pickling agents A, B, C and D were obtained by adding nitric acid to these water solutions so that the ratio of the nitrate ion concentration to the chloride ion concentration ([$NO_3^-$]/[$Cl^-$]) was 0.1, 0.2, 0.3 or 0.4 and adjusting the solutions to various pH values by means of sulfuric acid and sodium hydroxide. Thus, the values of [$NO_3^-$]/[$Cl^-$] for the groups A, B, C and D were 0.1, 0.2, 0.3 and 0.4, respectively.

The wires used in Example 1 were dipped individually in the pickling agents of the groups A, B, C and D, and were subjected to the anodic and cathodic electrolyzing treatments in succession.

With use of the pickling agents of the groups A, B, C and D, the anodic and cathodic electrolyzing treatments were executed under the following conditions. In both these treatments, the current density and the treatment time were adjusted to 10 A/dm$^2$ and 30 seconds, respectively, for the group A, 5 A/dm$^2$ and 60 seconds for the group B, 5 A/dm$^2$ and 90 seconds for the group C, and 10 A/dm$^2$ and 45 seconds for the group D.

Subsequently, the treated wires were struck and electroplated in succession with nickel under the same conditions of Example 1.

The resulting plated wires were subjected to the adhesion test in the same manner as in Example 1. Tables 4, 5, 6 and 7 show the results of this test for the cases where the pickling agents of the groups A, B, C and D were used, respectively.

TABLE 4

| | | Group A ([$NO_3^-$]/[$Cl^-$] = 0.1) | | | |
|---|---|---|---|---|---|
| | | pH value | | | |
| | | −2.0 | 0.0 | 2.0 | 4.0 |
| [$Cl^-$] (mol/l) | 0.1 | 126 | 120 | 121 | 94 |
| | 0.2 | 168 | 160 | 150 | 92 |
| | 0.3 | 287 | 291 | 289 | 104 |
| | 0.4 | 284 | 293 | 297 | 16 |
| | 1.0 | 341 | 316 | 308 | 123 |
| | 5.0 | 335 | 334 | 318 | 139 |
| | 10.0 | 329 | 329 | 312 | 181 |

TABLE 5

| | | Group B ([$NO_3^-$]/[$Cl^-$] = 0.1) | | | |
|---|---|---|---|---|---|
| | | pH value | | | |
| | | −2.0 | 0.0 | 2.0 | 4.0 |
| [$Cl^-$] (mol/l) | 0.1 | 131 | 122 | 136 | 86 |
| | 0.2 | 157 | 148 | 158 | 93 |
| | 0.3 | 301 | 294 | 299 | 98 |
| | 0.4 | 300 | 318 | 312 | 107 |
| | 1.0 | 325 | 321 | 308 | 118 |
| | 5.0 | 337 | 324 | 316 | 121 |
| | 10.0 | 326 | 327 | 309 | 168 |

TABLE 6

| | | Group C ([$NO_3^-$]/[$Cl^-$] = 0.3) | | | |
|---|---|---|---|---|---|
| | | pH value | | | |
| | | −2.0 | 0.0 | 2.0 | 4.0 |
| [$Cl^-$] (mol/l) | 0.1 | 94 | 91 | 98 | 78 |
| | 0.2 | 97 | 96 | 92 | 82 |
| | 0.3 | 116 | 99 | 94 | 87 |
| | 0.4 | 125 | 118 | 103 | 93 |
| | 1.0 | 151 | 148 | 162 | 93 |
| | 5.0 | 176 | 177 | 174 | 98 |
| | 10.0 | 189 | 186 | 181 | 102 |

TABLE 7

| | | Group D ([$NO_3^-$]/[$Cl^-$] = 0.4) | | | |
|---|---|---|---|---|---|
| | | pH value | | | |
| | | −2.0 | 0.0 | 2.0 | 4.0 |
| [$Cl^-$] (mol/l) | 0.1 | 76 | 72 | 74 | 54 |
| | 0.2 | 97 | 92 | 87 | 56 |
| | 0.3 | 105 | 103 | 66 | 62 |
| | 0.4 | 141 | 124 | 126 | 69 |
| | 1.0 | 165 | 153 | 148 | 72 |
| | 5.0 | 176 | 175 | 171 | 80 |
| | 10.0 | 175 | 179 | 164 | 97 |

As seen from any of Tables 4 to 7, the adhesion between the wire and the plating layer is improved when the chloride ion concentration ([$Cl^-$]) and the pH value of the pickling agent are 0.3 mol/l or more and 2 or less, respectively, even in the case where the pickling agent contains nitrate ions as well as chloride ions.

As the nitrate ion content increases, however, the adhesion between the wire and the plating layer is worsened in proportion. The results shown in Tables 4 to 7 indicate that the pickling agent used should preferably be adjusted so that [$NO_3^-$]/[$Cl^-$] is 0.2 or less in the case where it contains nitrate ions.

EXAMPLE 5

First, the nickel-titanium alloy wires of Example 1 were subjected to 60 seconds of anodic electrolyzing treatment with the current density of 5 A/dm$^2$ by the use of pickling agent obtained by adjusting the chloride ion concentration by means of sodium chloride added to ion-exchange water and adjusting the pH value be means of sulfuric acid only.

Subsequently, the treated wires were subjected to 60 seconds of cathodic electrolyzing treatment with the current density of 10 A/dm$^2$ by use of pickling agent obtained by adjusting the chloride ion concentration by means of hydrochloric acid added to ion-exchange water and adjusting the pH value by means of sulfuric acid and sodium hydrate.

Subsequently, after the treated wires were fully rinsed in water, their surfaces were struck with nickel under the same conditions of Example 1.

After the struck wires were fully rinsed water, their surfaces were plated with nickel under the same conditions of Example 1.

The resulting plated wires were subjected to the same adhesion test of Example 1.Table 8 shows the result of this test in terms of the relationships between [$Cl^-$] and pH.

TABLE 8

| | | pH value | | | |
|---|---|---|---|---|---|
| | | −2.0 | 0.0 | 2.0 | 4.0 |
| [$Cl^-$] (mol/l) | 0.1 | 138 | 141 | 142 | 82 |
| | 0.2 | 193 | 158 | 149 | 104 |
| | 0.3 | 299 | 306 | 301 | 102 |
| | 0.4 | 308 | 334 | 298 | 127 |
| | 1.0 | 349 | 349 | 329 | 116 |
| | 5.0 | 368 | 355 | 334 | 149 |
| | 10.0 | 372 | 347 | 309 | 193 |

As seen from Table 8, the adhesion between the nickel plating layer and the wire surface is mach improved when the chloride ion concentration ([$Cl^-$]) and the pH valuc of the pickling agent are 0.3 mol/l or more and 2 or less, respectively.

COMPARATIVE EXAMPLE 1

The wires used in Example 1 were subjected to only the cathodic electrolyzing treatment under conditions including the current density of 10 A/dm$^2$ and treatment time of one minute, without undergoing the anodic electrolyzing treatment. Thereafter, the treated wires were struck and electroplated with copper under the same conditions of Example 2.

The resulting wires were subjected to the adhesion test in the same manner as in Example 1. Table 9 shows the result of this test.

TABLE 9

| | | pH value | | | |
|---|---|---|---|---|---|
| | | −2.0 | 0.0 | 2.0 | 4.0 |
| [Cl$^-$] (mol/l) | 0.1 | 10 | 2 | 6 | 5 |
| | 0.2 | 2 | 8 | 19 | 4 |
| | 0.3 | 8 | 9 | 8 | 6 |
| | 0.4 | 9 | 11 | 10 | 15 |
| | 1.0 | 3 | 2 | 9 | 10 |
| | 5.0 | 17 | 18 | 5 | 7 |
| | 10.0 | 11 | 15 | 15 | 3 |

As seen from Table 9, the adhesion between the wire and the deposit is extremely worsened when the anodic electrolyzing treatment is not executed.

Supposedly, this is because the oxide film having been existing on the surface of the wire from the beginning cannot be thoroughly removed by the cathodic electrolyzing treatment only.

COMPARATIVE EXAMPLE 2

The wires used in Example 1 were subjected to only the anodic electrolyzing treatment under conditions including the current density of 10 A/dm$^2$ and treatment time of one minute, without undergoing the cathodic electrolyzing treatment. Thereafter, the treated wires were struck and electroplated with nickel under the same conditions of Example 1.

The resulting wires were subjected to the adhesion test in the same manner as in Example 1. Table 10 shows the result of this test.

TABLE 10

| | | pH value | | | |
|---|---|---|---|---|---|
| | | −2.0 | 0.0 | 2.0 | 4.0 |
| [Cl$^-$] (mol/l) | 0.1 | 30 | 8 | 11 | 19 |
| | 0.2 | 7 | 20 | 23 | 6 |
| | 0.3 | 16 | 12 | 13 | 11 |
| | 0.4 | 14 | 10 | 16 | 25 |
| | 1.0 | 14 | 9 | 9 | 31 |
| | 5.0 | 13 | 14 | 25 | 38 |
| | 10.0 | 8 | 20 | 17 | 20 |

As seen from Table 10, the adhesion between the wire and the plating layer is extremely worsened when only the anodic electrolyzing treatment is executed without being followed by the anodic electrolyzing treatment.

Supposedly, this is attributable to the following circumstances. Even though the oxide film having been existing on the surface of the wire from the beginning was removed by the anodic electrolyzing treatment, the wire surface was anodized to have another oxide film formed thereon, and the new oxide film remained entire without the execution of the cathodic electrolyzing treatment.

What is claimed is:

1. A plating method for a nickel-titanium alloy member, comprising the steps of:

subjecting a nickel-titanium alloy member to an anodic electrolyzing treatment at a current density of 1 to 20 A/dm$^2$ for about 1 to 10 minutes; and a cathodic electrolyzing treatment at a current density of 1 to 20 A/dm$^2$ for about 1 to 10 minutes in succession using an electrolyte containing chloride ions at a concentration of 0.1 mol/liter or more and a pH of 2 or less, or at a concentration of 0.4 mol/liter or more as an essential component thereof;

strike plating the treated nickel-titanium alloy member with a desired metal; and electroplating the struck nickel-titanium alloy member with a desired metal.

2. The plating method according to claim 1, wherein said electrolyte is an electrolyte having a chloride ion concentration of 0.3 mol/l or more and a pH value of 2 or less.

3. The plating method according to claim 1, wherein the chloride ion source of said electrolyte is selected from the group consisting of hydrochloric acid, sodium chloride, and mixtures thereof.

4. The plating method according to claim 1, wherein the pH value is adjusted by using sulfuric acid and sodium hydroxide.

5. The plating method according to claim 1, wherein said electrolyte contains other kinds of ions.

6. The plating method according to claim 5, wherein said other ions are nitrate ions.

7. The plating method according to claim 6, wherein the ratio of the nitrate ion concentration to the chloride ion concentration is 0.2 or less.

8. The plating method according to claim 1, wherein the metal for strike plating is Ni or Cu, and the metal for electroplating is Ni, Cu or Au.

9. The plating method according to claim 2, wherein the metal for strike plating is Ni or Cu, and the metal for electroplating is Ni, Cu or Au.

10. The plating method according to claim 9, wherein the metal for strike plating is Ni, and the metal for electroplating is Cu.

11. The plating method according to claim 9, wherein the metal for strike plating is Ni, and the metal for electroplating is Ni.

12. The plating method according to claim 9, wherein the metal for strike plating is Cu, and the metal for electroplating is Cu.

13. The plating method according to claim 9, wherein the metal for strike plating is Ni, and the metal for electroplating is Au.

* * * * *